US007820238B2

(12) United States Patent
DeBiccari et al.

(10) Patent No.: US 7,820,238 B2
(45) Date of Patent: Oct. 26, 2010

(54) COLD SPRAYED METAL MATRIX COMPOSITES

(75) Inventors: Andrew DeBiccari, North Branford, CT (US); Jeffrey D. Haynes, Stuart, FL (US); Douglas A. Hobbs, Jupiter, FL (US); Jeganathan Karthikeyan, Akron, OH (US)

(73) Assignee: United Technologies Corporation, Hartford, CT (US)

( * ) Notice: Subject to any disclaimer, the term of this patent is extended or adjusted under 35 U.S.C. 154(b) by 293 days.

(21) Appl. No.: 11/643,597

(22) Filed: Dec. 20, 2006

(65) Prior Publication Data

US 2008/0152801 A1 Jun. 26, 2008

(51) Int. Cl.
*B05D 1/12* (2006.01)

(52) U.S. Cl. ..... 427/190; 427/201

(58) Field of Classification Search ..... 427/196, 427/201

See application file for complete search history.

(56) References Cited

U.S. PATENT DOCUMENTS

| | | | | |
|---|---|---|---|---|
| 6,887,296 | B2 * | 5/2005 | Mende et al. | 75/351 |
| 2003/0219542 | A1 * | 11/2003 | Ewasyshyn et al. | 427/421 |
| 2005/0132843 | A1 * | 6/2005 | Jiang et al. | 75/252 |
| 2005/0214474 | A1 * | 9/2005 | Han et al. | 427/446 |

FOREIGN PATENT DOCUMENTS

| | | | |
|---|---|---|---|
| GB | 2 394 479 | * | 4/2004 |
| GB | 2394479 | A | 4/2004 |
| JP | 2006177697 | A | 7/2006 |
| WO | 2006107172 | A1 | 10/2006 |

OTHER PUBLICATIONS

Modern Ceramic Engineering, D.W. Richerson, Marcel Dekker Pub., 1984, pp. 160-162.*

Naiqin Zhao, et al., "The effect of mechanical alloying on SiC distribution and the properties of 6061 aluminum composite", Journal of Materials Processing Technology, 2005, vol. 170, p. 586-592

E.M. Ruiz-Navas, et al., "One step production of aluminium matrix composite powders by mechanical alloying", Composites: Part A Applied Science and Manufacturing 37, 2006, p. 2114-2120.

Lidong Zhao, et al., "HVOF spraying of AI2O3-dispersion-strengthened NiCr powders", Surface and Coatings Technology, 2004, vol. 182, p. 72-77.

Julio Villafuerte, et al., "Cold Spray: A New Technology", Welding Journal, American Welding Society, 2005, vol. 84, No. 5, p. 24-29.

European Search Report, EP 07 25 4756.

"Schatz Inversion Kinematic"; Sep. 20, 2004; Retr4ieved from the Internet: URL:http://www.inversionmixers.com/Schatz_inversion_kinematic.html[retrieved on Mar. 19, 2010]; 1994-2004 Inversion Machines, Ltd.

* cited by examiner

*Primary Examiner*—Frederick J Parker
(74) *Attorney, Agent, or Firm*—Bachman & LaPointe, P.C.

(57) ABSTRACT

A method of manufacturing homogenous metal matrix composite (MMC) powders and using the powders as the feedstock with cold spray deposition is described to produce composite coatings and freestanding bulk forms. Measured quantities of metal and ceramic powders having predetermined particle sizes are blended to produce homogeneous MMC powders. Spray parameters and procedures are controlled to produce dense, strong and well-bonded MMC coatings on any substrate.

18 Claims, 3 Drawing Sheets

COLD SPRAYED METAL MATRIX COMPOSITES

BACKGROUND OF THE INVENTION

The invention relates generally to the field of metal matrix composites. More specifically, the invention relates to methods for providing homogeneous metal matrix composite powders and using the powders as the feedstock for cold spray deposition to produce high quality composite coatings and freestanding bulk forms.

A metal matrix composite (MMC) is a type of composite material having at least two constituent parts, the matrix and a reinforcement. The matrix is typically a metal. The reinforcement may be a different metal or another material such as a ceramic or organic compound.

The matrix is a continuous frame into which the reinforcement is embedded. A path exists through the matrix to any point in the material. The matrix is usually a lighter metal such as aluminum, magnesium, or titanium, and provides a compliant support for the reinforcement. The materials can remain in an elemental form, in different alloy forms, and in mixtures of two or three different elements, their alloys and compounds. The matrix typically has a higher volume percentage in the composite.

The reinforcement is usually a ceramic. The ceramic may be carbides, nitrites, borides, oxides, or mixtures thereof, and be in either continuous form or discontinuous particulates. The ceramics are added to the matrix to enhance the strength, wear resistance, friction coefficient, thermal conductivity, and other factors.

Continuous reinforcement uses monofilament wires or fibers such as carbon fiber or silicon carbide. Because the fibers are directionally embedded into the matrix, the result is an anisotropic structure in which the alignment of the material affects its strength.

Discontinuous reinforcement is isotropic and can be worked using standard metalworking techniques. Discontinuous reinforcement uses short fibers or particles. The most common reinforcing materials in this category are alumina and silicon carbide.

MMC manufacturing can be broken into three types: solid, liquid, and vapor. Solid-state methods include powder blending and consolidation, and foil diffusion bonding. Powder blending and consolidation (powder metallurgy) is where powdered metal and discontinuous reinforcement are mixed and then bonded through a process of compaction, degassing, and thermo-mechanical treatment using, as one example, hot isostatic pressing (HIP) or extrusion. Foil diffusion bonding is where layers of metal foil are sandwiched with long fibers, and then pressed through to form a matrix.

Liquid-state methods include stir casting, squeeze casting, spray deposition and reactive processing. Stir casting is where discontinuous reinforcement is stirred into molten metal, which is allowed to solidify. Squeeze casting is where molten metal is injected into a form with fibers preplaced inside of it. Reactive processing involves a chemical reaction with one of the reactants forming the matrix and the other the reinforcement. Spray deposition is where molten metal is sprayed onto a continuous fiber substrate.

Vapor-methods use physical vapor deposition to coat fibers passed through a thick cloud of vaporized metal where the fibers are coated.

Metal matrix composites have found many applications in various industries. Aluminum and titanium alloys reinforced with ceramic fibers and particles have high specific strength values (high strength to weight ratios) and have found acceptance in many aerospace applications. Carbide reinforced metal coatings and bulk forms have exceptional wear resistance and are used in many tribological applications. However, many problems still exist in the preparation of industrial components using these MMC materials.

Thermal spray techniques such as flame, high velocity and plasma, that are performed in an open air environment lead to oxidation of the metal powders. Oxidation results in an unacceptable composite bulk form.

Delamination (bond failure) at the matrix-particulate interface may arise due to improper selection of particle sizes, blending techniques or consolidation procedure. Catastrophic failure of the MMC may occur in the operational environment.

During consolidation processing, decomposition, preferential evaporation and degradation of one or the other component may occur. These reactions result in poor quality MMCs with inferior performance characteristics.

Spray coating a tungsten carbide-cobalt powder leads to decarborization and matrix dissolution. This results in a less hard coating. Consolidation techniques can also cause incorporation of inclusions such as oxides during the consolidation process. Improperly prepared composite powder, coating or bulk form not only leads to loss of strength, wear resistance, and other attributes, but adversely affect the thermal and mechanical properties of the material.

It is a challenge to form high performance MMCs as freestanding bulk forms.

SUMMARY OF THE INVENTION

Although there are various methods for forming metal matrix composites into composite coatings and freestanding bulk forms, such methods are not completely satisfactory. The inventors have recognized that it would be desirable to have methods of providing homogenous metal matrix composite (MMC) powders and using the powders as the feedstock for cold spray deposition. Measured quantities of metal and ceramic powders having predetermined particle sizes are blended to produce homogeneous MMC powders. Spray parameters and procedures are controlled to produce dense, strong and well-bonded MMC coatings on any substrate.

One aspect of the invention provides methods for a metal matrix composite coating. Methods according to this aspect of the invention preferably start with providing a matrix powder having a particle range of from 20 to 55 microns, providing a reinforcing powder having a particle range of from 1 to 30 microns, combining a predetermined volume of the matrix powder with a predetermined volume of the reinforcing powder, blending the predetermined amount of the matrix powder with the predetermined amount of the reinforcing powder to form a metal matrix composite powder, providing a substrate, and depositing the metal matrix composite powder onto a surface of the substrate using a non-oxidizing carrier gas such that the metal matrix composite powder plastically deforms and bonds to the substrate and itself upon impact with the substrate surface trapping the reinforcing powder.

Another aspect of the method comprises feeding the metal matrix composite powder to a spray nozzle at a feed rate of from 1.0 grams/min to 3.0 grams/min at a pressure in the range of from 200 psi to 500 psi using a carrier gas selected from the group consisting of helium, nitrogen, an inert gas and mixtures thereof.

Other objects and advantages of the methods and systems will become apparent to those skilled in the art after reading the detailed description of the preferred embodiments.

DETAILED DESCRIPTION

Embodiments of the invention will be described with reference to the accompanying drawing figures wherein like numbers represent like elements throughout. Further, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. The terms "mounted," "connected," and "coupled" are used broadly and encompass both direct and indirect mounting, connecting, and coupling. Further, "connected" and "coupled" are not restricted to physical or mechanical connections or couplings.

Embodiments of the invention disclose methods of providing homogenous metal matrix composite (MMC) powders and using the powders as the feedstock for cold spray deposition to produce composite coatings and freestanding bulk forms. Measured quantities of metal and ceramic powders having predetermined particle sizes are blended to produce homogeneous MMC powders.

Proper cold spray deposition parameters and operational procedures produce dense, strong and well-bonded MMC coatings. Coatings of up to several millimeters may be formed over metal mandrels to produce freestanding MMC bulk forms.

The invention can use any deposition process that provides sufficient energy to accelerate particles to a high enough velocity such that, upon impact, the matrix particles plastically deform and bond to a surface, building a relatively dense coating or structural deposit. The surface may be the surface of a substrate, or a previously applied layer of the metal matrix composite comprising matrix and reinforcing particles, where the matrix powder may bond to the reinforcing particles as well as to itself. The deposition process does not metallurgically transform the particles from their solid state.

Various techniques to achieve this type of particle deposition have been evaluated and reduced to practice such as cold gas dynamic spraying (cold spray deposition), kinetic metallization, electromagnetic particle acceleration, modified high velocity air fuel spraying, or high velocity impact fusion (HVIF). These are examples of high velocity deposition processes where metallurgical transformation of powder metal particles is not encountered. Preferably, the invention uses the cold spray deposition process. However, the invention may use other cold deposition processes.

To make an MMC powder, two or more materials having particle sizes in the range of 20 to 55 microns are blended together. Homogeneity increases as particle sizes decreases. However, particles that are too small may agglomerate instead of blend with the particles of the other materials.

Particle sizes that are too large may lead to lateral compositional variations in the consolidation bulk form and may produce a porous bulk form. This results in an inhomogeneous composite.

Figure 1:
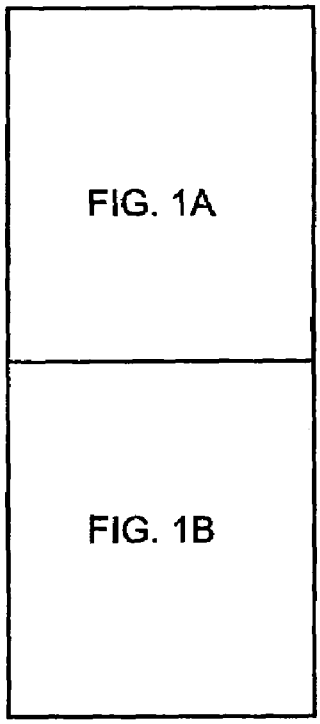
FIG. 1 is a block diagram of an exemplary method according to the invention.
Figure 1A:
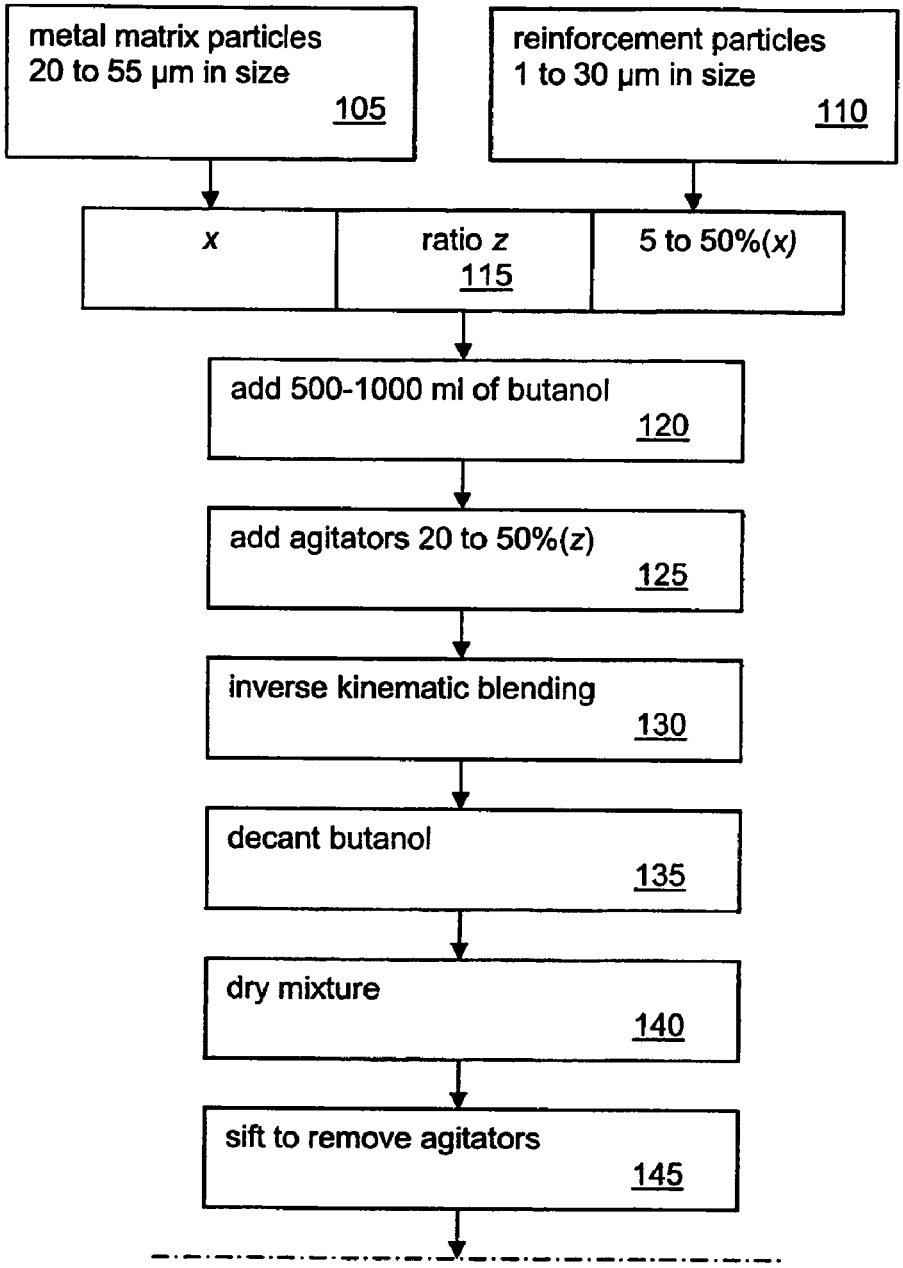
Figure 1B:
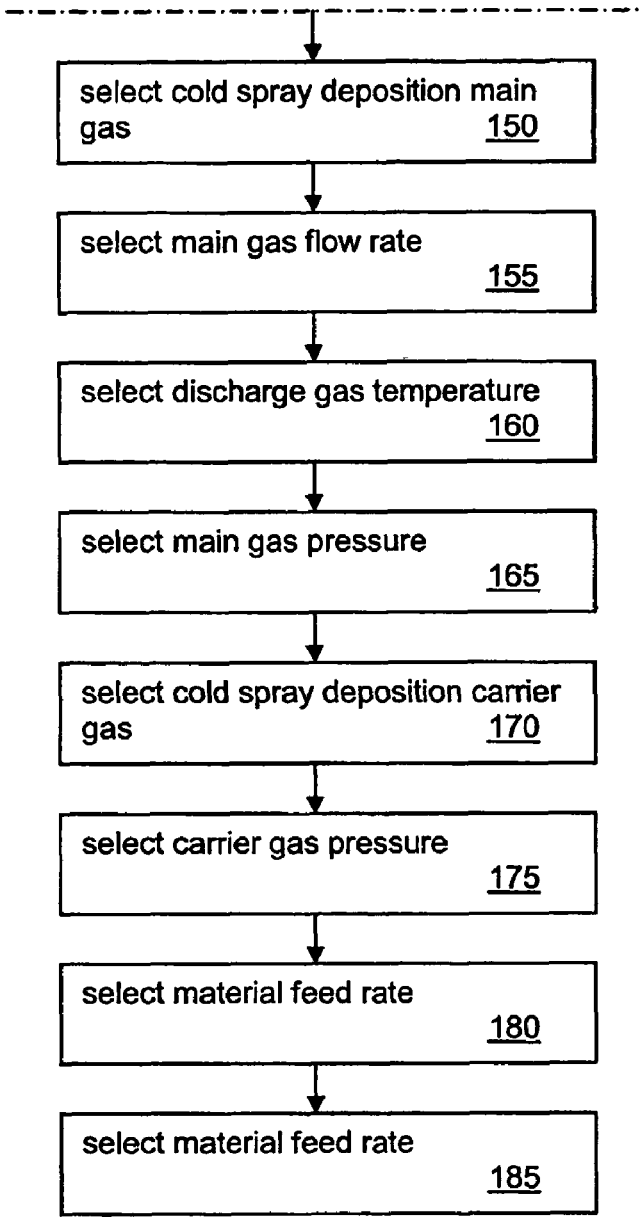

The method of the invention is shown in FIG. 1 and addresses and optimizes the aforementioned problems. The method of the invention specifies metal matrix powders having a particle size in the range of from 20 to 55 microns (μm) (step 105) and ceramic reinforcing powders having a particle size range of from 1 to 30 microns (step 110) be used.

Measured quantities of the metal powders are mixed with a preferable 15 to 25 volume percent of the ceramic reinforcing powders (step 115). The quantity of the ceramic reinforcing powders may be as high as 50 volume percent.

To produce uniform, homogeneous MMC powder and to avoid the formation of explosive metal dusts, wet blending of the MMC powder is performed. Butanol may be used as a liquid carrier and is added to the MMC powder (step 120). Other low viscosity fluids that dry or evaporate may be used, such as alcohol, provided that the liquid carrier is not corrosive to the powder.

To ensure proper mixing during wet blending, high density zirconia or alumina balls that resist fracturing when tumbled together having a diameter in a range of from 2 to 4 mm are added to the slurry (step 125). The amount of zirconia balls added to the slurry is in a range of from 20 to 50 weight percent.

The slurry may be blended in a low-energy, three-dimensional inversion kinematic mixing ball mill (step 130). For difficult mixing problems such as the homogeneous blending of particulate solids, the Schatz inverse kinematic is used. The inversion kinematic is gentle such that almost no shear forces are generated.

After the blending operation is over, the butanol is decanted (step 135) and the mixture dried for 24 hours (step 140). The dry MMC material is sifted in a sieve shaker to remove the zirconia agitator balls and any large particles or agglomerates that may have formed (step 145).

The MMC material may then be used as a feedstock for deposition.

The method of the invention uses cold spray deposition where a supersonic gas jet is formed by a converging/diverging nozzle and is used to accelerate the powder particles towards the substrate to produce cold spray coatings. In this process, the coating materials are not heated to high temperature and hence no oxidation, decomposition or other degradation reactions of the feedstock material occur.

To achieve a good quality coating in a reproducible manner, the invention sets forth operational parameters to obviate too high of a gas preheat temperature where softening of the matrix powder may occur contributing to nozzle blockage, too low of a gas preheat temperature, for example, below 250° C. where the powder particles do not attain the required critical velocity and will bounce off of a substrate, and powder-feed rates that are not sufficiently high such that loading of the gas jet results. Loading is where too much matrix powder is admitted and jams the nozzle.

The method of the invention sets forth predetermined cold spray deposition process parameters in the ranges shown in Table 1.

TABLE 1

| Parameter | Value |
|---|---|
| Nozzle type | circular<br>rectangle |
| Gas type | nitrogen<br>helium<br>mixtures |
| Gas flow rate | 5-50 scfm |
| Gas pressure (gun) | 200-500 psi |
| Carrier gas pressure (hopper) | 200-500 psi |
| Gas temperature | 200-500° F. |
| Powder feed rate | 1.0-3.0 rpm |
| Stand off distance | 10-50 mm |

The cold spray deposition system includes a spray gun having a converging/diverging nozzle through which the MMC material is sprayed onto a substrate surface.

The particles of the MMC material may be accelerated to supersonic velocities using a compressed gas, such as helium, nitrogen, other inert gases, and mixtures thereof. Helium is a preferred gas because it produces the highest velocity due to its low molecular weight.

The bonding mechanism employed by the method of the invention for transforming the MMC material into a coating or freestanding bulk form is strictly solid state, meaning that the particles do not melt. The matrix powder plastically deforms upon impact at high velocity, bonding to the substrate and any previously deposited matrix powder. The consolidated matrix powder traps the reinforcing powder. In certain instances, the matrix powder may bond directly with the reinforcing powder. Any oxide layer that is formed on the particles, or is present on the component surface, is broken up and fresh metal-to-metal contact is made at very high pressures.

The MMC powder used to form the deposit may be fed to the spray gun using any suitable means known in the art, such as modified thermal spray feeders. Fluidized bed feeders and barrel roll feeders with an angular slit may also be used.

In the method of the invention, the feeders may be pressurized with a gas selected from the group consisting of helium, nitrogen, other inert gases, and mixtures thereof (step 150). Feeder pressures are generally 15 psi above the main gas or head pressures, which pressures are usually in the range of from 200 psi to 500 psi, depending on the powdered repair material composition.

The main gas is heated so that gas temperatures are in the range of from 600° F. to 1,200° F. If desired, the main gas may be heated as high as approximately 1,250° F. depending on the material being deposited. The gas may be heated to keep it from rapidly cooling and freezing once it expands past the throat of nozzle. The net effect is a surface temperature on the part being repaired of about 115° F. during deposition. Any suitable means known in the art may be used to heat the gas.

To deposit the MMC material, the nozzle may pass over the surface of the part more than once. The number of passes required is a function of the thickness of the deposit. The method is capable of forming a deposit having any desired thickness. When applying the MMC material, it is desirable to limit the thickness per pass in order to avoid a quick build up of residual stresses and unwanted debonding between deposit layers.

The main gas that is used to deposit the particles of the MMC material onto the surface may be passed through the nozzle at a flow rate of from 0.001 SCFM to 50 SCFM, preferably in the range of from 15 SCFM to 35 SCFM (step 155). The foregoing flow rates are preferred if helium is used as the main gas. If nitrogen is used by itself or in combination with helium as the main gas, the nitrogen gas may be passed through the nozzle at a flow rate of from 0.001 SCFM to 30 SCFM, preferably from 4 to 30 SCFM. Alternatively, the nozzle may have a single inlet which is connected to a valve for switching between two gases.

The main gas temperature may be in the range of from 600° F. to 1,200° F., preferably from 700° F. to 1,000° F., and most preferably from 725° F. to 900° F. (step 160).

The pressure of the spray gun may be in the range of from 200 psi to 500 psi, preferably from 200 psi to 400 psi and most preferably 275 psi to 375 psi (step 165). The MMC material is fed from a hopper, which is under a pressure of 10 to 50 psi higher than the specific main gas pressure, preferably 15 psi higher, to the spray gun via line at a rate in the range of from 10 grams/min to 100 grams/min, preferably from 15 grams/min to 50 grams/min.

The MMC material is fed to the spray gun using a non-oxidizing carrier gas. The carrier gas may be introduced having a pressure in a range of from 200 to 500 psi and at a flow rate of from 0.001 SCFM to 50 SCFM, preferably from 8 SCFM to 15 SCFM (step 180). The foregoing flow rate is useful if helium is used as the carrier gas. If nitrogen by itself or mixed with helium is used as the carrier gas (step 170), a flow rate of from 0.001 SCFM to 30 SCFM, preferably from 4 to 10 SCFM, may be used (step 175).

The nozzle spray distance from the substrate surface is not determined by the deposit thickness. Preferably, the spray distance is in a range of from 10 mm to 50 mm (step 185). For example, if a 3 mm thick deposit is required, the nozzle may begin at a starting spray distance of 25 mm. As the MMC material is deposited, the nozzle distance of 25 mm is maintained from the surface of the deposited MMC material, not the original substrate surface. In this manner, the same distance is maintained regardless of the deposited MMC material thickness. The deposition process is insensitive to small variations in nozzle spray distance. For some deposits of less than a predetermined thickness, such as 0.2 inch, the nozzle spray distance may not require adjusting as deposition progresses.

The velocity of the MMC material particles leaving the spray nozzle may be in the range of from 825 m/s to 1400 m/s. Preferably from 850 m/s to 1200 m/s. The deposit thickness per pass may be in the range of from 0.001 inches to 0.030 inches.

In an example, aluminum alloy powders having a 20-50 micron particle size were blended with carbide having a 1-15 micron particle size to produce discontinuously reinforced aluminum (DRA) MMC powder. The powder was cold sprayed onto various substrates and metal mandrels. Dense strong coatings having thicknesses in the range of 10 to 1000 microns were produced over many substrates including oxygen free high conductivity copper. Coatings of up to 5 mm were produced over mandrels. Removal of the metal substrate resulted in a dense and strong MMC bulk form.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A method for forming a metal matrix composite coating comprising:

providing a metal matrix powder having a particle range of from 20 to 55 microns;

providing a ceramic reinforcing powder having a particle size of from 1 to 30 microns;

combining from 5 to 50 volume percent of said ceramic reinforcing powder with a predetermined volume of said metal matrix powder;

wet blending said metal matrix powder with said ceramic reinforcing powder to form a metal matrix composite;

said wet blending step comprising adding a liquid carrier to form a slurry and adding high density zirconia or alumina balls in a range of from 20 to 50 wt % to said slurry;

drying said slurry to form a dry metal matrix composite material in powder form;

removing said balls and any large particles or agglomerates that may have formed;

providing a substrate;

forming a supersonic gas jet using a converging/diverging spray nozzle;

introducing said metal matrix composite powder into said supersonic gas jet; and depositing said metal matrix composite powder at supersonic speed onto a surface of said substrate using said supersonic jet such that said metal matrix composite powder plastically deforms and bonds to said substrate and itself upon impact with said substrate surface trapping said reinforcing powder.

2. The method according to claim 1 wherein said metal matrix powder is selected from the group consisting of aluminum, nickel, titanium, silicon, and mixtures thereof.

3. The method according to claim 2 wherein said ceramic reinforcing powder is selected from the group consisting of boron carbide, tungsten carbide, silicon carbide, titanium carbide and mixtures thereof.

4. The method according to claim 2, wherein said ceramic reinforcing powder is selected from the group consisting of silicon nitride, boron nitride, titanium nitride, and mixtures thereof.

5. The method according to claim 2 wherein said ceramic reinforcing powder is selected from the group consisting of aluminum oxide, zirconium oxide, silicon oxide and mixtures thereof.

6. The method according to claim 2 wherein said ceramic reinforcing powder is a combination of two or more carbides, nitrides, and oxides.

7. The method according to claim 6 wherein said wet blending step comprises adding a liquid carrier to said metal matrix powder and said ceramic reinforcing powder.

8. The method according to claim 7 wherein said blending step comprises using an inverse kinematic motion.

9. The method according to claim 8 further comprising decanting said liquid carrier from said metal matrix composite powder.

10. The method according to claim 1 wherein said removing step comprises sifting said metal matrix composite powder.

11. The method according to claim 10 further comprising feeding said metal matrix composite powder to said spray nozzle at a feed rate of from 1.0 grams/min to 3.0 grams/min at a pressure in the range of from 200 to 500 psi using a carrier gas selected from the group consisting of helium, nitrogen, an inert gas and mixtures thereof.

12. The method according to claim 11 wherein said carrier gas comprises helium and said feeding step comprises feeding said helium to said nozzle at a flow rate of from 5 SCFM to 50 SCFM.

13. The method according to claim 12 wherein said depositing step further comprises passing said metal matrix composite powder through said nozzle using a main gas selected from the group consisting of helium, nitrogen, and mixtures thereof at a main gas temperature in the range of from 200 degrees Fahrenheit to 1,250 degrees Fahrenheit and at a spray pressure in the range of from 200 psi to 500 psi.

14. The method according to claim 13 further comprising maintaining said nozzle at a distance from 10 mm to 50 mm from said surface.

15. The method according to claim 14 wherein said surface is the surface of deposited metal matrix composite or the substrate surface.

16. The method according to claim 1 wherein said combining step comprises combining from 15 to 25 volume percent of said ceramic reinforcing powder with a predetermined volume of said metal matrix powder.

17. The method according to claim 1 wherein said high density zirconia or alumina balls adding step comprises adding balls having a diameter in the range of from 2 to 4 mm.

18. The method according to claim 1 wherein said combining step comprises combining from 5 to 50 volume percent of a carbide having a 1 to 15 micron particle size with an aluminum alloy powder having a 20 to 50 micron particle size so as to produce a discontinuously reinforced aluminum powder.

* * * * *